US008129639B2

(12) United States Patent
Youn et al.

(10) Patent No.: US 8,129,639 B2
(45) Date of Patent: Mar. 6, 2012

(54) EMBLEM-UNIFIED TRUNK OPENING AND CLOSING DEVICE

(75) Inventors: Sun Kyoung Youn, Seoul (KR); Phil Jung Jeong, Gyeonggi (KR); Sang Won Lee, Gyeonggi (KR); Jae Young Kang, Gyeonggi (KR)

(73) Assignee: Kia Motors Corporation, Seoul (KR)

( * ) Notice: Subject to any disclaimer, the term of this patent is extended or adjusted under 35 U.S.C. 154(b) by 375 days.

(21) Appl. No.: 12/422,121

(22) Filed: Apr. 10, 2009

(65) Prior Publication Data

US 2010/0116635 A1 May 13, 2010

(30) Foreign Application Priority Data

Nov. 13, 2008 (KR) ..... 10-2008-0112615

(51) Int. Cl.
*H01H 13/08* (2006.01)
*H01H 13/06* (2006.01)

(52) U.S. Cl. ..... 200/61.62; 200/302.2; 200/341; 200/345; 200/330

(58) Field of Classification Search ..... 200/61.62, 200/341–345, 302.1, 302.2, 517, 520, 329, 200/330, 331; 49/279–281; 292/336.3, 347
See application file for complete search history.

(56) References Cited

U.S. PATENT DOCUMENTS

| | | | | |
|---|---|---|---|---|
| 3,594,529 | A * | 7/1971 | Cartwright | 200/330 |
| 5,340,955 | A * | 8/1994 | Calvillo et al. | 200/302.2 |
| 7,244,897 | B2 * | 7/2007 | Villagrasa et al. | 200/61.85 |
| 7,273,991 | B2 * | 9/2007 | Korultay et al. | 200/61.62 |
| 7,485,825 | B2 * | 2/2009 | Nishikawa et al. | 200/520 |
| 7,518,072 | B2 * | 4/2009 | Yoda | 200/61.62 |
| 7,683,278 | B2 * | 3/2010 | Kakita et al. | 200/302.2 |
| 7,777,141 | B2 * | 8/2010 | Ishiguro | 200/61.52 |

FOREIGN PATENT DOCUMENTS

EP 2090728 A2 * 8/2009

* cited by examiner

*Primary Examiner* — Michael Friedhofer
(74) *Attorney, Agent, or Firm* — Morgan, Lewis & Bockius LLP

(57) ABSTRACT

An emblem-unified trunk opening and closing device may include a housing including an outer case and an inner case, wherein the outer case is attached to a stationary member and includes a guide hole and the inner case includes a guide passage, a knob attached to the outer case of the housing, wherein the knob includes an emblem configured to be movable through the guide hole of the outer case, a connector provided in the guide passage of the inner case and to which a terminal electrically contacting an outer electric source is set, a printed circuit board ("PCB") disposed inside the guide passage of the inner case and configured to electrically contact the terminal, and a contact unit configured to selectively contact the PCB by actuation force of the emblem so as to apply an electric current to the terminal of the connector.

14 Claims, 4 Drawing Sheets

EMBLEM-UNIFIED TRUNK OPENING AND CLOSING DEVICE

CROSS-REFERENCE TO RELATED APPLICATIONS

This application claims priority to Korean Patent Application Number 10-2008-0112615 filed Nov. 13, 2008, the entire contents of which are incorporated herein for all purposes by this reference.

BACKGROUND OF THE INVENTION

1. Field of the Invention

The present invention relates to an emblem-unified trunk opening and closing device, and more particularly, to an emblem-unified trunk opening and closing device enhancing operation credibility and durability.

2. Description of Related Art

An emblem representing an automotive company is generally attached to the front side and the rear side of an automobile, and in case of being attached to the rear side, it is attached to a surface of a trunk of an automobile An emblem which is attached to the rear side of an automobile is generally attached by adhesive or a screw, and an emblem is separately produced and is attached to a surface of a trunk by a worker, so manufacturing process becomes long. In addition, an emblem which is attached to a surface of a trunk by adhesive or the like may be separated from a surface of a trunk by lapse of time.

In order to solve this problem, a method of unifying an emblem to a trunk opening and closing device to lessen troublesome process and to enhance durability has been introduced.

A conventional emblem-unified trunk opening and closing device will be explained with reference to the drawings hereinafter.

FIG. 1 is a sectional view of a prior emblem-unified trunk opening and closing device, and FIG. 2 shows operation state of FIG. 1.

As shown in the drawing, a conventional emblem-unified trunk opening and closing device includes a housing 10 which is formed by an inner case 13 and an outer case 11, a knob 20 to which an emblem is attached and a plunger P is provided at a front end thereof and which is formed to be pushed and return with respect to the housing 10, a connector 30 which is provided at a front end part of the housing 10 and is provided with a terminal T which is electrically connected to an external electric source, a printed circuit board 40 which is disposed at one side of the plunger P and is electrically connected to the terminal T, and a contact member 50 which is elastically disposed between the plunger P and the printed circuit board 40 and contacts the printed circuit board 40 when the knob 20 is pushed so as to electrically connect the terminal T of the connector 30 to the external electric source thereby releasing a locking device of a trunk.

Here, the inner case 13 of the housing 10 is provided with a pair of bolts B which are provided at both sides thereof, and double coated tapes 15 are respectively attached to sides of the bolts B so as to be fixed to an outer surface of a trunk.

The knob 20 is formed such that a trunk can be opened by pushing the knob 20 without using a key of an automobile. Accordingly it is attached to an upper portion of a plunger P by adhesive or the like and can be movable vertically in upward and downward directions by predetermined values in a space formed at an upper portion of the inner case 13.

In addition, the contact member 50 is made of silicon, and is formed to wrap the whole upper surface of the connector 30 in a packing type to maintain waterproof from the outside thereby preventing electric short.

Reference numeral 31 which is not explained above is a connecting part of the connector 30 which is connected to a body part of an external electric source, and reference numeral 51 is a pair of electricity applying portions which are provided at a lower portion of the contact member 50.

An operation of a conventional emblem-unified trunk opening and closing device will be explained hereinafter.

If a user pushes the knob 20 to which an emblem is attached in order to open a trunk, the plunger P which is formed to be integral with the knob 20 moves vertically in a downward direction.

By the vertical downward movement of the plunger P, the contact member 50 moves downwardly and is compressed, and the pair of the electricity applying portion 51 contacts the printed circuit board 40 which is electrically connected to the terminal T of the connector 30, so electricity is applied.

Accordingly, if electricity is applied, a trunk cover is separated from a hook part of a trunk locking device, so the trunk is opened.

Just after the trunk is opened, the plunger P returns to its original state by the elastic force of the contact member 50 which has been compressed during the downward movement of the plunger P, and electricity is cut off.

However, in a conventional emblem-unified trunk opening and closing device, in case that the pushing force of a user is applied near the edge instead of a center part, a lower surface of the plunger P does not surface-contact two positions of the contact member 50 at the same time, so contact with the printed circuit board 40 does not stable, and accordingly release of the locking device of the trunk by electrical connection to the external electric source cannot not be normally achieved.

Furthermore, the elasticity of the contact member 50 gradually deteriorates by frequent use, so a user's operation feeling gradually decreased, and finally the knob 20 cannot return to its original state, so there is a problem that electrical connection to the external electric source can be constantly maintained and thereby the release state of the locking device of the trunk continues.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an emblem-unified trunk opening and closing device which achieves smooth contact by the pushing force of a user and prevents deterioration of an operation feeling.

In an aspect of the present invention, an emblem-unified trunk opening and closing device may include a housing including an inner case and an outer case, a knob including an emblem configured to be pushed and restored with respect to the outer case outside the housing, a connector which is provided at a front end of the inner case and to which a terminal which electrically contacts an outer electric source is set, a printed circuit board which is disposed inside the inner case to be supported and is formed to be able to electrically contact the terminal, and a contact unit which selectively contacts the printed circuit board in response to a push operation of the emblem so as to apply an electric current to the terminal of the connector thereby opening a trunk.

The contact unit may include an upper guide which is coupled to the inner case to move together with the emblem, a rubber cap, a lower portion of which is coupled to an upper portion of the connector and an upper portion of which is elastically compressed by movement of the upper guide, a lower guide which moves in a state that an upper portion thereof is restrained to an inner side of the rubber cap, and a tact switch which is provided with an electricity applying portion which surface-contacts a lower portion of the lower guide to be elastically pushed during movement of the lower guide to contact the printed circuit board.

The lower portion of the lower guide may be formed to correspond to a cone shape such that pushing force to the electricity applying portion of the tact switch is concentrated.

In another aspect of the present invention, an emblem-unified trunk opening and closing device may include a housing including an outer case and an inner case, wherein the outer case is attached to a stationary member and includes a guide hole and the inner case includes a guide passage, a knob attached to the outer case of the housing, wherein the knob includes an emblem configured to be movable through the guide hole of the outer case, a connector provided in the guide passage of the inner case and to which a terminal electrically contacting an outer electric source is set, a printed circuit board ("PCB") disposed inside the guide passage of the inner case and configured to electrically contact the terminal, and a contact unit configured to selectively contact the PCB by actuation force of the emblem so as to apply an electric current to the terminal of the connector.

The stationary member may be a vehicle body.

The contact unit may be configured to sealingly enclose the connector and receive the PCB therein.

The contact unit may include an upper guide slidably coupled to the guide passage of the inner case to move with the emblem, an elastic member elastically supporting the upper guide, a lower portion of which is coupled to an upper portion of the connector and an upper portion of which is elastically engaged with the upper guide, a lower guide coupled to the elastic member and configured to selectively contact the PCB by the actuation force of the emblem, and a switch including an electricity applying portion which contacts a lower portion of the lower guide to be elastically pushed during movement of the lower guide to contact the PCB.

Upper portion of the guide passage may have a guide protrusion to restrain movement of the upper guide within a predetermined distance.

The lower guide may be attached to and sealingly enclosed by the elastic member.

The upper portion of the elastic member may include a cone portion to point-contact lower portion of the upper guide.

The cone portion of the elastic member and the electricity applying portion of the switch may be co-axially disposed.

Upper portion of the elasticity applying portion may include a concave portion to receive the cone portion of the lower guide.

The lower portion of the lower guide may include a cone portion to transfer the actuation force of the emblem to the electricity applying portion of the PCB.

The cone portion of the lower guide and the electricity applying portion of the switch may be co-axially disposed.

Upper portion of the elasticity applying portion may include a concave portion to receive the lower portion of the lower guide.

The upper portion of the elastic member may include a cone portion to point-contact lower portion of the upper guide, the lower portion of the lower guide includes a cone portion to transfer the actuation force of the emblem to the electricity applying portion of the PCB, and upper portion of the elasticity applying portion includes a concave portion to receive the cone portion of the lower guide.

The cone portion of the elastic member, the cone portion of the lower guide and the concave portion of the electricity applying portion may be co-axially disposed.

The switch may be a tact switch.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An emblem-unified trunk opening and closing device according to various embodiments of the present invention will hereinafter be described in detail with reference to the drawings.

Terms and words used in the specification and claims should not interpreted limitedly as general literal meanings, and should be interpreted as meanings and concepts which are complied with the spirit of the invention in conformity with the principle that the inventor can define the meaning of words in order to explain the invention in best way.

Figure 1:
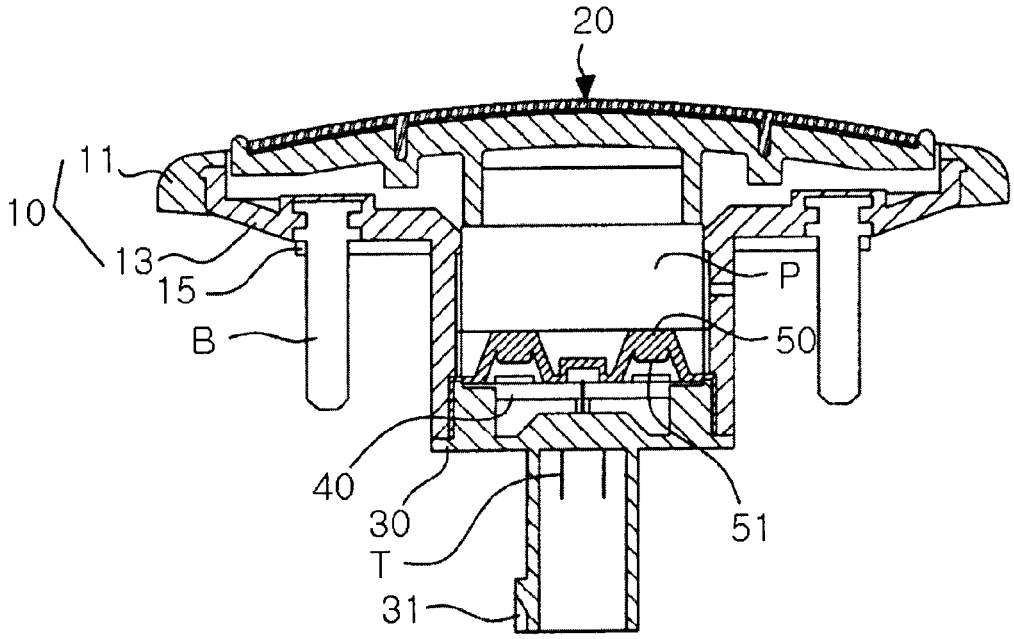
FIG. 1 (Prior Art)
FIG. 1 is a sectional view of an exemplary emblem-unified trunk opening and closing device.
Figure 2:
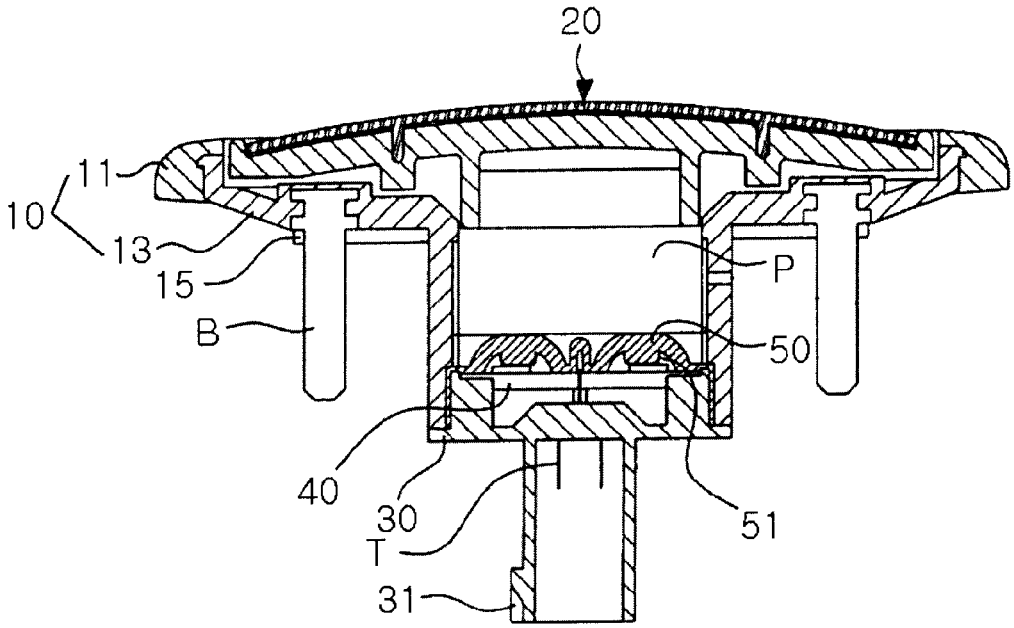
FIG. 2 (Prior Art)
FIG. 2 shows operation state of FIG. 1.
Figure 3:
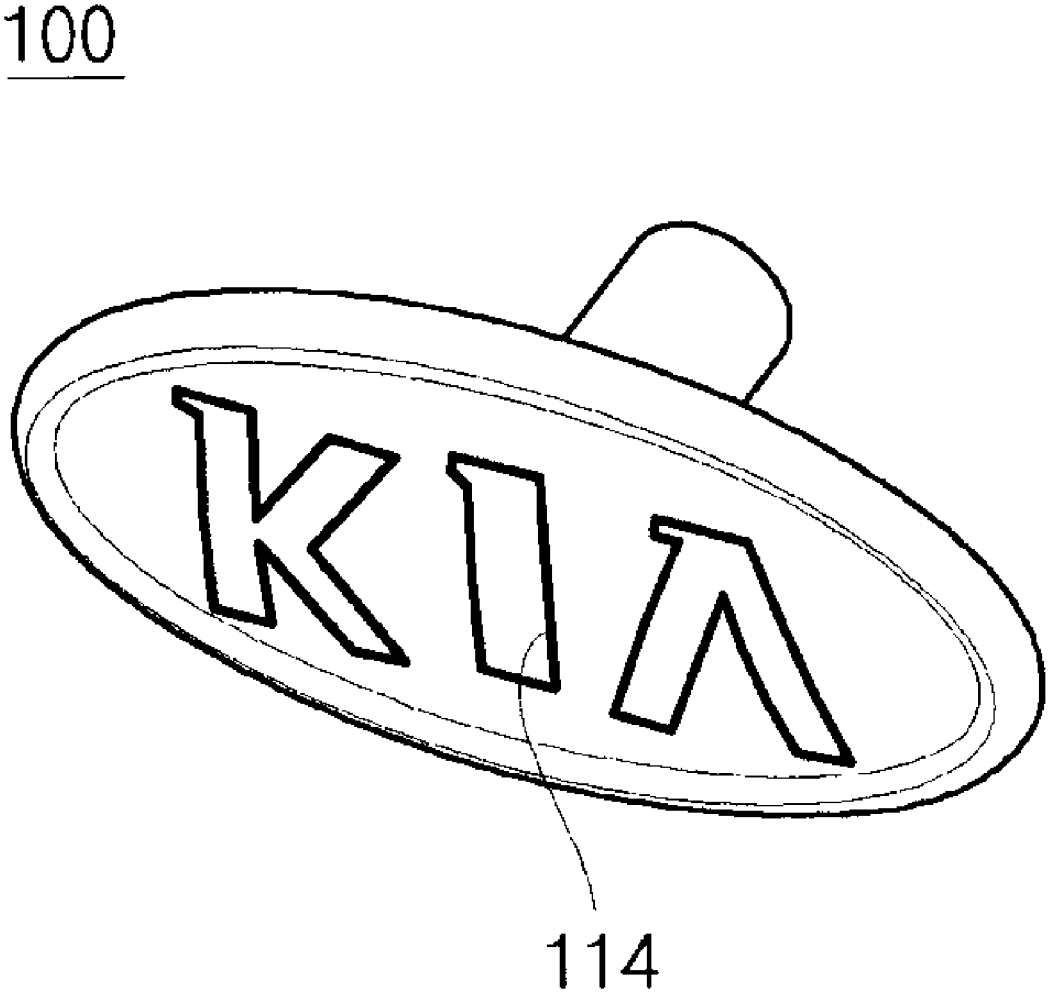
FIG. 3 is a perspective view of an exemplary emblem-unified trunk opening and closing device according to the present invention.
Figure 4:
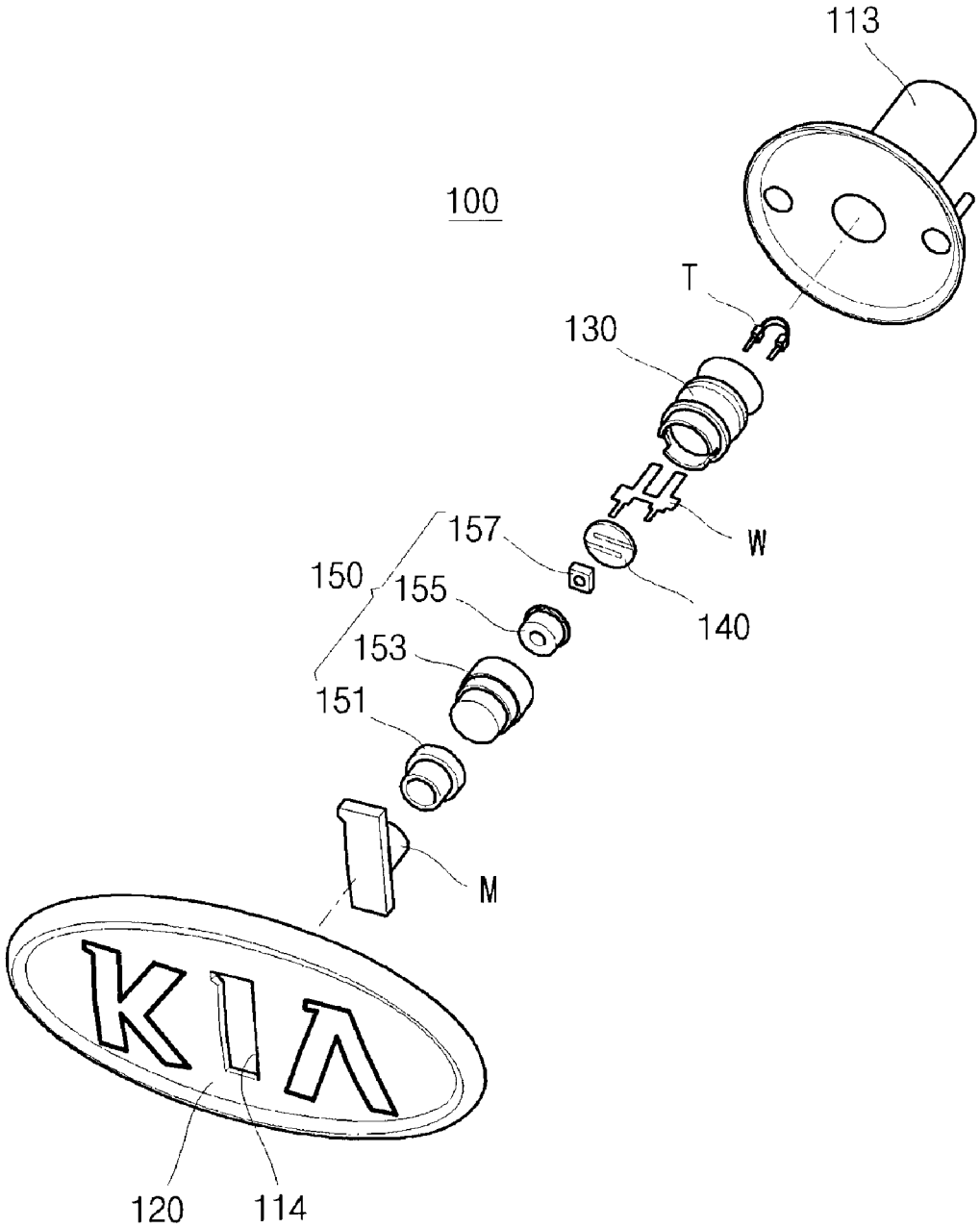
FIG. 4 is an assembling view of FIG. 3.
Figure 5:
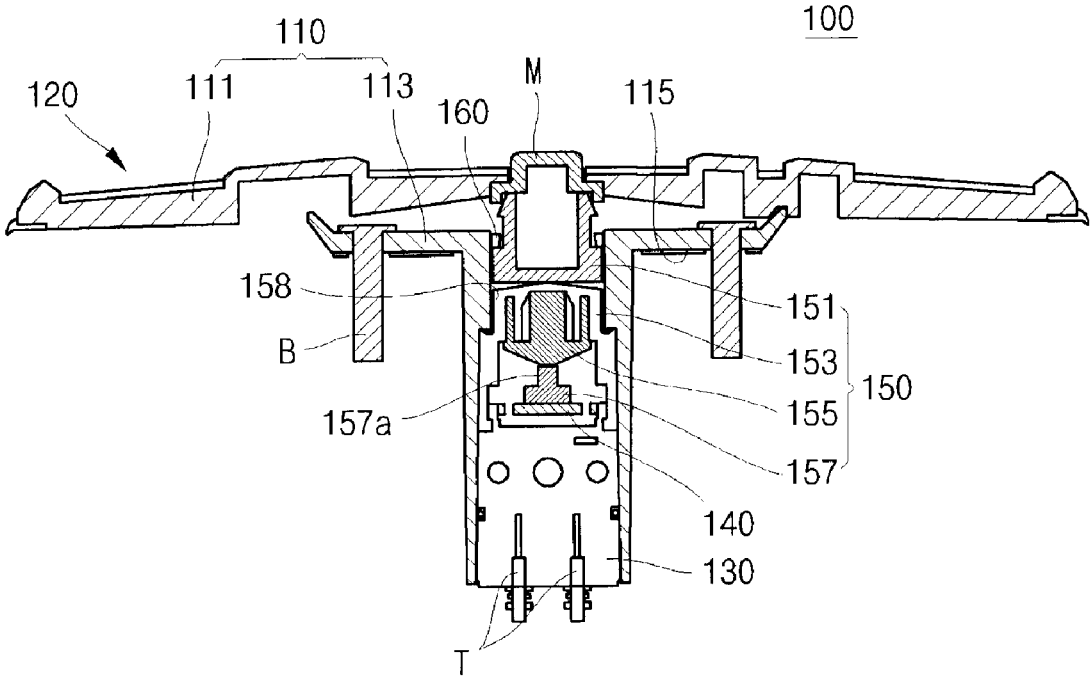
FIG. 5 is a sectional view of FIG. 3.

FIG. 3 is a perspective view of an emblem-unified trunk opening and closing device according to various embodiments of the present invention, FIG. 4 is an assembling view of FIG. 3, and FIG. 5 is a sectional view of FIG. 3.

As shown in the drawing, an emblem-unified trunk opening and closing device 100 according to various embodiments of the present invention includes a housing 110 formed by combination of an inner case 113 and an outer case 111, a knob 120 which is provided so that an emblem M, which represents a motor company, is installed so as to be able to be pushed and be restored with respect to the outer case 111 outside the housing 110, a connector 130 which is provided at a front end of the inner case 113 and to which a terminal T which electrically contacts an outer electric source is set, a printed circuit board 140 which is disposed inside the inner case 113 to be supported and is formed to be able to electrically contact the terminal T, and a contact unit 150 which selectively contacts the printed circuit board 140 in response to an push operation of the emblem M so as to apply an electric current to the terminal T of the connector 130 thereby releasing a locking device of a trunk.

Here, the inner case 113 of the housing 110 is provided with a pair of bolts B which are provided at both sides thereof, and double coated tapes 115 are respectively attached at sides of the bolts B so as to be fixed to an outer surface of a trunk.

Meanwhile, the contact unit 150 includes an upper guide 151 which is coupled to a lower portion of the emblem M in an insertion type so as to be movable in upward downward directions in FIG. 5 together with the emblem M, a rubber cap 153, a lower portion of which is coupled to an upper portion of the connector 130 in a hook type thereby being supported and is formed such that an upper portion thereof is elastically compressible in a surface contact state with the upper guide 151, a lower guide 155, an upper portion of which is sealing-coupled to an inner side of the rubber cap 153 to move upward and downward with the upper portion of the rubber cap 153, and a tact switch 157 which is provided with an electricity applying portion 157*a* which surface-contacts a lower portion of the lower guide 155 to be elastically pushed during movement of the lower guide 155 to act as a switch to contact the printed circuit board 140.

It is preferable that the lower portion of the lower guide 155 is formed in a cone shape rather than a planar shape so that pushing force of the center part of the tact switch 157 can be concentrated onto the electricity applying portion 157*a*.

In various embodiments of the present invention, the upper portion of the rubber cap 153 is formed in a cone shape rather than a planar shape so that pushing force of the emblem M can be concentrated thereto.

The tact switch 157 is formed such that the center part thereof is concave by a curvature ratio of the lower portion of the lower guide 155, and an elastic member such as a spring is interposed in the concave part so as to elastically receive the electricity applying portion 157*a*.

It is preferable that the cone-shaped upper and lower portions of the rubber cap 153 and the lower guide 155 are aligned to be coaxial with electricity applying portion 157*a* of the tact switch 157 so that pushing force of the emblem M can be concentrated to the center part of the tact switch 157.

Reference numeral W which is not explained above represents a wire which electrically connects the terminal T for the connector 130 and the printed circuit board 140.

Hereinafter, an operation of an emblem-unified trunk opening and closing device 100 will be explained with reference to the drawings.

First, if a user pushes the emblem M through a guide hole 114 of the knob 120 to open the trunk, the upper guide 151 which is coupled to a guide protrusion 160 formed at guide passage 158 of the inner case 113 to slidably receive the upper guide 151 thereto, is compressively inserted into the inner case 111 of the housing 110 and moves vertically in a downward direction in FIG. 5 together with the emblem M.

By the vertical downward movement of the upper guide 151, the lower guide 155 descends simultaneously with the elastic compression of the rubber cap 153.

Accordingly, while the electricity applying portion 157*a* of the tact switch 157 which surface-contacts the cone portion of the lower guide 155 is pressed onto the concave part of the tact switch 157, the printed circuit board 140 which is electrically connected to the terminal T of the connector 130 contacts so that electricity is applied.

As such, if electricity is applied, a trunk cover is released from a hook part of a locking device for opening and closing the trunk and thereby the trunk is opened.

Just after the trunk is opened, the emblem M returns to its original position by elastic force of the rubber cap 153 of the contact unit 50 and the electricity applying portion 157*a* which are compressed during the downward movement of the emblem M is also returned to the original state and thus electricity is cut off.

As described above, in an emblem-unified trunk opening and closing device 100 according to various embodiments of the present invention, the pushing force of a user is concentrated at one spot through the contact unit 150, so a problem in a prior art of insufficient contact with the printed circuit board 140 by dispersion of the pushing force can be solved.

Furthermore, in spite of frequent use, since the elastic force of the contact unit 150 uses two members of the rubber cap 153 and the tact switch 157, the phenomenon of deterioration of user's operation feeling can be solved, and since electrical connection with an external electric source is always maintained unlike the prior art, malfunction that the release state of the locking device of the trunk is maintained can also be solved.

For convenience in explanation and accurate definition in the appended claims, the terms "up", "upper", "downward", "lower", "front", "inner", and "upwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An emblem-unified trunk opening and closing device comprising:

a housing including an inner case and an outer case;

a knob including an emblem configured to be pushed and restored with respect to the outer case outside the housing;

a connector which is provided at a front end of the inner case and to which a terminal which electrically contacts an outer electric source is set;

a printed circuit board which is disposed inside the inner case to be supported and is formed to be able to electrically contact the terminal; and a contact unit arranged in the inner case, the contact unit being selectively in contact with the printed circuit board in response to a push operation of the emblem so as to apply an electric current to the terminal of the connector thereby opening a trunk;

wherein the contact unit comprises:

an upper guide coupled to the emblem;

a rubber cap, a lower portion of which being coupled to an upper portion of the connector and an upper portion of which being in surface-contact with the upper guide;

a lower guide coupled to the rubber cap via an upper portion thereof;

a tact switch being provided with an electricity applying portion being in surface-contact with a lower portion of the lower guide to be elastically pushed by the lower guide to contact the printed circuit board;

wherein the upper guide and the lower guide are reciprocated in the inner case by external force applied to the upper guide and elastic force of the rubber cap; and wherein the lower portion of the lower guide has a cone shape, and the electricity applying portion of the tact switch is co-axially disposed with the cone shaped lower portion of the lower guide to allow pushing force to be concentrated onto the electivity applying portion.

2. The emblem-unified trunk opening and closing device of claim 1, wherein the rubber cap is disposed in a guide passage formed in the housing.

3. An emblem-unified trunk opening and closing device, comprising:

a housing including an outer case and an inner case, wherein the outer case is attached to a stationary member and includes a guide hole and the inner case includes a guide passage;

a knob attached to the outer case of the housing, wherein the knob includes an emblem configured to be movable through the guide hole of the outer case;

a connector provided in the guide passage of the inner case and to which a terminal electrically contacting an outer electric source is set;

a printed circuit board ("PCB") disposed inside the guide passage of the inner case and configured to electrically contact the terminal; and a contact unit arranged in the inner case, the contact unit being selectively in contact with the PCB by actuation force of the emblem so as to apply an electric current to the terminal of the connector;

wherein the contact unit comprises:

an upper guide slidably coupled to the emblem;

an elastic member, a lower portion of which being coupled to an upper portion of the connector and an upper portion of which being elastically engaged with the upper guide;

a lower guide coupled to the elastic member via an upper portion thereof; and a switch including an electricity applying portion being in contact with a lower portion of the lower guide to be elastically pushed by the lower guide to contact the printed circuit board;

wherein the upper guide and the lower guide are reciprocated in the inner case by external force applied to the upper guide and elastic force of the elastic member; and wherein the lower portion of the lower guide has a cone shape, and the electricity applying portion of the switch is co-axially disposed with the cone shaped lower portion of the lower guide to allow pushing force to be concentrated onto the electivity applying portion.

4. The emblem-unified trunk opening and closing device of claim 3, wherein the stationary member is a vehicle body.

5. The emblem-unified trunk opening and closing device of claim 3, wherein upper portion of the guide passage have a guide protrusion to restrain movement of the upper guide within a predetermined distance.

6. The emblem-unified trunk opening and closing device of claim 3, wherein the lower guide is attached to and sealingly enclosed by the elastic member.

7. The emblem-unified trunk opening and closing device of claim 3, wherein the upper portion of the elastic member includes a cone portion to point-contact lower portion of the upper guide.

8. The emblem-unified trunk opening and closing device of claim 7, wherein the cone portion of the elastic member and the electricity applying portion of the switch are co-axially disposed.

9. The emblem-unified trunk opening and closing device of claim 8, wherein upper portion of the elasticity applying portion includes a concave portion to receive the cone portion of the lower guide.

10. The emblem-unified trunk opening and closing device of claim 3, wherein upper portion of the elasticity applying portion includes a concave portion to receive the lower portion of the lower guide.

11. The emblem-unified trunk opening and closing device of claim 3, wherein the upper portion of the elastic member includes a cone portion to point-contact lower portion of the upper guide, the lower portion of the lower guide includes a cone portion to transfer the actuation force of the emblem to the electricity applying portion of the PCB, and upper portion of the elasticity applying portion includes a concave portion to receive the cone portion of the lower guide.

12. The emblem-unified trunk opening and closing device of claim 11, wherein the cone portion of the elastic member, the cone portion of the lower guide and the concave portion of the electricity applying portion are co-axially disposed.

13. The emblem-unified trunk opening and closing device of claim 3, wherein the switch is a tact switch.

14. The emblem-unified trunk opening and closing device of claim 3, wherein the elastic member is disposed in the guide passage.

* * * * *